US010090081B2

(12) United States Patent
Ritthammer

(10) Patent No.: US 10,090,081 B2
(45) Date of Patent: Oct. 2, 2018

(54) CABLE AND METHOD FOR ITS MANUFACTURE

(71) Applicant: LEONI KABEL HOLDING GMBH, Nuremberg (DE)

(72) Inventor: Marcus Ritthammer, Georgsmuend (DE)

(73) Assignee: LEONI Kabel Holding GmbH, Nuremberg (DE)

( * ) Notice: Subject to any disclaimer, the term of this patent is extended or adjusted under 35 U.S.C. 154(b) by 0 days.

(21) Appl. No.: 15/044,259

(22) Filed: Feb. 16, 2016

(65) Prior Publication Data

US 2016/0247600 A1 Aug. 25, 2016

(30) Foreign Application Priority Data

Feb. 13, 2015 (DE) ..... 10 2015 202 708

(51) Int. Cl.

| | |
|---|---|
| ***H01B 7/00*** | (2006.01) |
| ***H01B 7/18*** | (2006.01) |
| *H01B 13/00* | (2006.01) |
| *H01B 11/00* | (2006.01) |

(52) U.S. Cl.

CPC ..... *H01B 7/1825* (2013.01); *H01B 11/00* (2013.01); *H01B 13/0013* (2013.01)

(58) Field of Classification Search

CPC ..... H01B 3/02–3/30; H01B 3/47; H01B 3/48; H01B 7/02; H01B 7/025; H01B 7/0275; H01B 7/0283; H01B 7/0291; H01B 7/17; H01B 7/18; H01B 9/02; H01B 9/024; H01B 11/02; H01B 11/1834

USPC ..... 174/110 R, 113 R, 120 R, 121 R

See application file for complete search history.

(56) References Cited

U.S. PATENT DOCUMENTS

| | | | | |
|---|---|---|---|---|
| 2,732,422 | A * | 1/1956 | Rapp | H01B 7/1895 174/116 |
| 2,800,524 | A * | 7/1957 | Van Lear | H01B 7/29 174/116 |
| 3,406,248 | A * | 10/1968 | Bunish | B29C 47/0016 174/120 R |
| 5,789,711 | A * | 8/1998 | Gaeris | H01B 11/02 174/113 C |
| 7,208,683 | B2 | 4/2007 | Clark | |
| 8,445,787 | B2 * | 5/2013 | Nordin | H01B 11/085 174/110 R |
| 2005/0199415 | A1 * | 9/2005 | Glew | G02B 6/4429 174/113 C |
| 2006/0169478 | A1 * | 8/2006 | Clark | H01B 11/04 174/113 C |

(Continued)

FOREIGN PATENT DOCUMENTS

| | | | |
|---|---|---|---|
| DE | 102008003593 | A1 | 7/2009 |
| WO | 0154139 | A1 | 7/2001 |

*Primary Examiner* — William H Mayo, III

(74) *Attorney, Agent, or Firm* — Laurence A. Greenberg; Werner H. Stemer; Ralph E. Locher

(57) ABSTRACT

A cable, in particular a data cable, extends in a longitudinal direction and has a number of lines and a structural element extending in the longitudinal direction for stiffening the cable. The lines are embedded in the structural element. Here, the lines and the structural element are surrounded by a common shield made of a conductive material. Due to the special arrangement of the shield, a particularly compact structure can be provided. A method for producing the cable is also provided.

20 Claims, 1 Drawing Sheet

(56) References Cited

U.S. PATENT DOCUMENTS

| | | | | |
|---|---|---|---|---|
| 2006/0201698 | A1* | 9/2006 | Mjelstad | H01B 7/045 174/113 C |
| 2007/0102188 | A1* | 5/2007 | Glew | H01B 7/295 174/113 C |
| 2008/0226240 | A1* | 9/2008 | Mumm | H01B 11/04 385/101 |
| 2009/0126971 | A1* | 5/2009 | Fok | H01B 11/06 174/113 A |
| 2010/0147549 | A1* | 6/2010 | Shiina | H01B 7/295 174/113 C |
| 2011/0220387 | A1* | 9/2011 | Szylakowski | H01B 7/295 174/113 C |
| 2012/0222883 | A1* | 9/2012 | Nordin | H01B 11/08 174/113 C |
| 2014/0262425 | A1* | 9/2014 | Hopkinson | H01B 11/06 174/107 |
| 2014/0262427 | A1* | 9/2014 | Brown | H01B 3/301 174/113 C |

* cited by examiner

CABLE AND METHOD FOR ITS MANUFACTURE

BACKGROUND OF THE INVENTION

Field of the Invention

The invention relates to a cable, in particular a data cable, which extends in a longitudinal direction and has a number of lines and also a structural element extending in a longitudinal direction for stiffening the cable, the lines and the structural element being surrounded by a common shield made of a conductive material. The invention also relates to a method for producing a cable of this type.

A corresponding cable is presented for example in WO 01/54139 A1.

The cable is in particular a data cable which extends in a longitudinal direction and has a number of lines and also a structural element extending in a longitudinal direction for stiffening the cable, the lines being embedded in the structural element.

A cable of this type is used routinely in applications in which the cable has to be pushed forwards, for example in the case of what are known as sewer cameras or pipe camera. In this case, the cable must have a certain mechanical stability, since it is not merely laid in position, but is often also used to push forwards a device mounted thereon, for example a camera or another sensor system. The cable is therefore on the one hand subject to considerable loading by forces acting in a longitudinal direction. On the other hand curved paths also often have to be negotiated depending on the application, and therefore the cable is additionally subjected to corresponding bending loads.

In order to be able to absorb additional application-induced forces and ensure maximum mechanical stability with maximum flexibility, it is known in general to provide the cable with an additional structural element which is produced from a material having high rigidity alongside a high elongation at failure. Here, glass fiber-reinforced or carbon fiber-reinforced plastics or glass fibers or carbon fibers combined with resins or the like are used in particular and are often incorporated as fibers or rods in a longitudinal direction of the cable.

The cable then has a structure in which a number of structural elements are joined to a number of lines to form the cable. Here, the lines are usually data lines or signal lines which are shielded against interfering signals. In order to produce the cable, the finished lines are then combined with the structural elements to form the cable, for example the lines or other cores or other components are stranded around the structural element, which is formed from a multiplicity of endless fibers. This arrangement is then usually provided with a common outer sheathing.

Shielded lines in particular, however, often have a much greater diameter compared with unshielded lines, since a shield of the line must be arranged at a suitable distance from the conductor in order to ensure specific electrical properties, in particular a specific wave impedance. The line therefore has an insulation that has an accordingly large wall thickness, which then also leads to an accordingly increased spatial requirement of the line in the cable. In other words, the diameter of shielded lines is enlarged in particular on account of an increased insulation wall thickness compared with unshielded lines. Accordingly, a larger structural element then also has to be selected in order to accommodate the lines and at the same time be able to utilize the advantageous mechanical properties of the structural element. The increased spatial requirement of the lines in the structural element then results in an accordingly thicker design thereof in order to continue to avoid a rupture or bursting.

In document WO 01/54139 A1 mentioned in the introduction a communication cable is described having a plurality of twisted-pair cables, which each lie in recesses in a filler element. The recesses are approximately tubular and are arranged at the edge of the filler element, such that in each case an opening slot is formed, via which a respective twisted-pair cable can be laid in the recess. A respective recess has a larger cross-sectional area than the twisted-pair cable inserted therein. The filler element is lastly surrounded by an outer sheathing. A shield layer is optionally also arranged between the filler element and the outer sheathing.

BRIEF SUMMARY OF THE INVENTION

On this basis, the object of the invention is to specify an improved cable, which has a more compact structure, in particular compared with conventional cables having a structural element and shielded lines.

The object is achieved in accordance with the invention by a cable having the features as claimed and by a method for producing a cable as claimed. Advantageous embodiments, developments and variants are disclosed in the dependent claims. Here, the details specified hereinafter in respect of the cable also apply correspondingly to the method, and vice versa.

The cable is in particular a data cable, which extends in a longitudinal direction and has a number of lines and also a structural element extending in a longitudinal direction for stiffening the cable. Here, the lines are embedded in the structural element and these, specifically the lines and the structural element, are surrounded by a common shield made of a conductive material.

The term embedded is understood in particular to mean that the lines are arranged in the structural element without gaps. This is contrary to cables in which a number of recesses are formed in a structural element, in which recesses the lines are then laid or placed. In this respect the structural element in the present case is not a profiled part combined with the lines. Rather, the structural element is tailor-made, such that the lines are arranged at a fixedly defined position relative to the structural element. A shifting, in particular transversely to the longitudinal direction, within a recess is thus prevented, in contrast to an embodiment with a recess which is larger than the line arranged therein. Rather, a respective line is in the present case embedded in the structural element in an interlocking manner. A particularly accurate positioning of the line relative to the overall structure of the cable is thus provided. An accurate positioning of this type is also advantageous from an electrical viewpoint, particularly in the case of a data cable, since the distance from the common shield critically determines the transfer properties of the line and therefore the quality of the data transfer. A fixed distance in this case leads to correspondingly fixed properties, whereas a line arranged loosely so to speak in the structural element could shift slightly during operation and in some circumstances may then alter the transfer properties of the entire cable.

A further advantage that can be obtained with the invention lies in particular in the fact that the entire structural element with the lines embedded therein is shielded in a particularly simple manner by merely a single shield, and therefore the lines can be manufactured with significantly reduced diameter, in particular compared with conventional embodiments. A certain wave impedance of a respective line will be, and is, then set substantially by the common shield, such that a separate shielding of the lines is no longer necessary, which is advantageous. The lines can then thus be produced in particular with a significantly reduced insulation wall thickness, whereby the spatial requirement of the lines in the cable is in turn advantageously reduced and the structural element is more stable accordingly. As viewed in the cross section of the cable, the smaller spatial requirement of the line, more specifically of the insulation of the line, enables a corresponding filling with material of the structural element. An enlargement of the overall diameter of the cable is then advantageously avoided accordingly. In particular in comparison to a conventional cable having identical electrical properties, the cable presented here is more compact in terms of its diameter with at least identical or even improved mechanical stability.

Due to the arrangement of the shield around the structural element, there is additionally an enlarged distance of the shield from the embedded lines in particular in comparison with separately shielded lines, and therefore it is also possible to form the cores with a particularly thin wall thickness.

In particular since a suitable shielding of the lines is provided with the common shield, individual shields for the lines are preferably done away with. In other words, the lines are preferably formed un-shielded, in particular merely as conductors or as insulated conductors, i.e. as cores. Due to the abandonment of an individual shielding of this type or separate shielding of the lines, it is possible to form the insulation thereof with a particularly thin wall thickness or even to omit this entirely, whereby the spatial requirement of the corresponding line in the cable as a whole is significantly reduced. In other words, by forming the common shield applied directly to the structural element and by doing away with a separate shielding for each of the lines, a significant reduction of the diameter of the lines is possible.

The lines are in particular data lines or signal lines, for example USB lines, Firewire lines or Ethernet lines, or power lines, for supplying a consumer, for example a camera or generally a sensor. A respective data line is then used for example for the transfer of digital signals, and a power line is used for the transfer of in particular a low power, for example in the range of a few tens of watts. The lines therefore each preferably have a conductor having a cross section in the range from approximately 0.03 $mm^2$ to 0.5 $mm^2$ in particular in the case of data lines, and up to approximately 2.5 $mm^2$ in particular in the case of power lines. In a suitable development a number of these conductors are each surrounded by an additional insulation. The diameter of an individual line lies here in particular for example in the range from 0.4 to 2.2 mm in particular in the case of data lines, and up to approximately 3 mm in particular in the case of power lines.

The shield is produced from a conductive material, for example from copper, and is preferably embodied as a braid, wound covering, or wrapping, whereby the shield can be produced particularly easily. In a suitable embodiment the shield is applied directly to the structural element and by way of example is braided therearound. This shield preferably has a shield thickness that lies in the range from 0.1 mm to 0.5 mm.

The structural element, also referred to as a supporting element, is produced in particular from a fiber material, more specifically from a multiplicity of fibers, in particular endless fibers, alternatively split fibers for example having a maximum length of a few centimeters.

In order to produce the cable the lines are preferably bundled jointly with a multiplicity of such fibers to form a common composite in order to embed the lines, in particular in an interlocking manner. The lines and the structural element thus advantageously form a composite without gaps, in which the material of the structural element is placed around the lines without gaps. This composite is then drawn through a resin bath in order to fill the remaining spaces in the composite and in order to provide a particularly fixed bonding of the fibers to one another. In addition, the lines are expediently also integrally bonded to the structural element as a result, in that the lines are glued so to speak to the structural element by means of the resin. A heat treatment is then performed expediently, for example in a furnace, in order to cure the resin. In a variant the structural element is produced from a multiplicity of split fibers, which are brought together in combination with a filler material, in particular resin, for example via an extrusion process, in order to form the structural element.

The lines are preferably embedded in a fiber-resin matrix. The resin is in particular an irreversibly curable material. The resin is an epoxy, for example. Here, both one-component and two-component systems are suitable. The fiber-resin matrix forms the structural element.

In order to attain a particularly uniform load-bearing capability of the cable in the radial direction, i.e. in all directions perpendicular to the longitudinal direction, the structural element is preferably guided centrally. This is understood in particular to mean that the structural element is arranged centrally with respect to the entire cable structure and extends accordingly in the longitudinal direction.

The structural element expediently has a circular peripheral contour perpendicularly to the longitudinal direction, i.e. in the radial direction. The cable is thus suitable in an optimal manner for applications in which the cable is pushed forwards and then accordingly does not become canted on account of the round shape. The circular peripheral contour is also advantageous in particular with regard to the distribution of forces when the cable is subject to a bending load.

In an expedient variant the structural element is formed as a cylinder, in which the lines are embedded. These are externally protected in a particularly optimal manner against ambient influences, since the lines are completely surrounded by the structural element. In particular, any spaces formed by the lines are also filled here by the structural element. A further advantage of this arrangement in particular lies in the fact that an accordingly maximum distance of the shield from the lines is also produced by a central arrangement of the lines and in this way the lines can be made particularly thin, at the same time with similar electrical properties, i.e. in particular wave impedance. Here, the structural element for example has an outer diameter of approximately 6 mm and the inner chamber has an inner chamber diameter of just approximately 1.5 mm, such that a wall thickness of approximately 2.2 mm is produced.

In a suitable alternative the lines are each arranged in a radial direction in an outermost portion of the structural element. Here, in a variant, the structural element is formed in particular as a cylinder, in particular with centrally arranged fibers. Due to the outer layer of the lines, these can be distanced particularly suitably from one another so as to also minimize the extent to which the lines influence one another.

The lines are preferably distributed uniformly in the peripheral direction. On the one hand the lines influence one another to a particularly small extent as a result; on the other hand the housing of the lines in the structural element necessarily results in a corresponding number of recesses, in each of which a line is arranged, but no material of the structural element. The weak points of the structural element potentially resulting from this are then likewise uniformly distributed in an optimal manner, whereby the stability of the structural element as a whole is significantly improved in turn.

In a preferred embodiment at least one line comprises a plurality of conductors insulated from one another, said conductors being stranded with one another. The line is accordingly formed as a multi-core line and is used for example as a two-pole power line or two-core data line.

In order to form a particularly rigid structural element, this is produced in a preferred embodiment from a glass fiber-reinforced or carbon fiber-reinforced material. Such reinforced materials have a particularly highly breaking strength and at the same time a particularly high bending flexibility. Here, the material is for example a resin or a plastic, by means of which the fibers are connected to one another to form the structural element.

In order to further improve the stability of the cable, a stabilizing layer is arranged between the structural element and the shield in a preferred development. This stabilizing layer is applied to the structural element in particular directly and is then surrounded by the shield. Here, the stabilizing layer is produced in particular from the same fibers as the structural element. The stabilizing layer is then preferably (cross) wound radially around the structural element and in this way supports the fibers of the structural element, which run substantially longitudinally. The stabilizing layer is in particular applied before immersion in a resin bath, such that the stabilizing layer and the structural element then form a unit in the finished state.

In an expedient development the cable comprises an outer sheathing, which surrounds the shield, i.e. it is applied thereto in particular directly. In particular, an improved protection of the structural element and of the lines with respect to ambient influences is provided by means of the outer sheathing.

On account of the particularly compact design of the cable, this is suitable in particular for the examination of environments in very confined spaces. Since a particularly good compressive strength is provided in addition by means of the structural element, in particular in the longitudinal direction, the cable is also particularly suitable for applications in which the cable is pushed forwards. The cable is therefore preferably used for the examination of pipelines and is accordingly used in a camera system suitable for this purpose. A camera system of this type, in addition to the cable, then comprises a camera attached to the end of the cable, in particular mechanically and also electrically. The cable is then used on the one hand to supply the camera with power, to transmit data from the camera to a receiving and control apparatus connected to the other end of the cable, and to move the camera. Here, the camera has a length in particular in the range from approximately 1 to 100 m.

BRIEF DESCRIPTION OF THE SEVERAL VIEWS OF THE DRAWING

Exemplary embodiments will be explained in greater detail hereinafter on the basis of a drawing. In the drawing.

DESCRIPTION OF THE INVENTION

Figure 1:
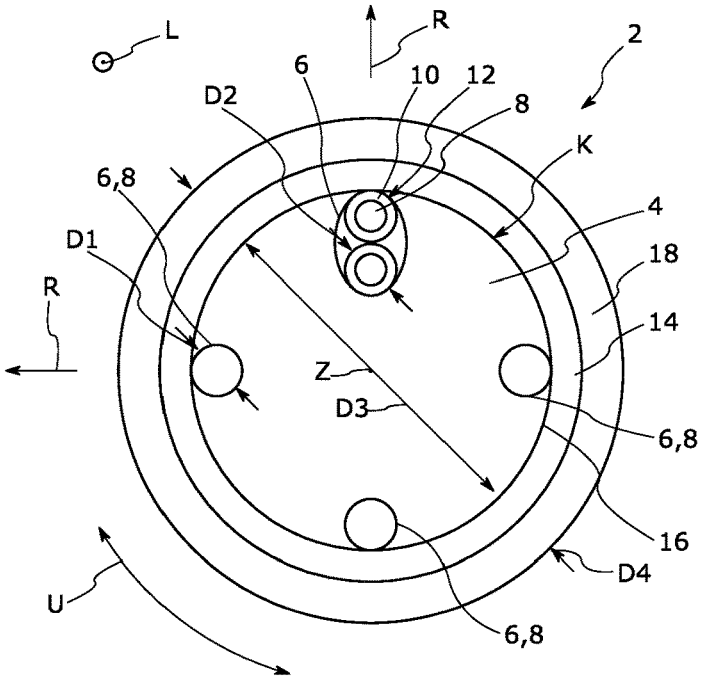
FIG. 1 schematically shows an end view of a cable.

FIG. 1 shows a first exemplary embodiment of a cable 2, which comprises a centrally guided structural element 4, in which a number of lines 6 (here four lines) are embedded. In the embodiment shown here these lines 6 are arranged in an outermost portion of the structural element 4, i.e. radially outwardly and within a peripheral contour K of the structural element 4 extending in the peripheral direction U, in particular adjacently to said contour. Three of the lines 6 illustrated here are formed as single conductors 8 and in the exemplary embodiment shown here do not comprise any further insulation 10 or shielding. These conductors 8 are made of a conductive material, for example copper or aluminum and in particular are in direct contact with the structural element 4. The fourth line 6 is formed here as a core pair and accordingly comprises two conductors 8, which are each surrounded by an insulation 10. Two cores 12 are thus formed, which here are stranded with one another in particular.

The lines 6 are each un-shielded, i.e. do not have a separate shield or separate shield layer. Instead, the entire structural element 4 with the lines 6 embedded therein is surrounded by a common shield 14. This is formed in particular as a braid made of a conductive material.

In the example shown here the conductors 8 each have a diameter D1 of approximately 0.25 mm. The cores 12 each have a diameter D2 of approximately 0.8 mm. The structural element 4 here in particular has a diameter D3 of approximately 6 mm, and the cable 2 as a whole then has a diameter D4 of approximately 8 mm.

The shield 14 here does not bear directly against structural element 4, and rather a stabilizing layer 16 is arranged between these two elements, which stabilizing layer is formed here in particular likewise as a braid from the same fibers as the structural element 4 and forms an outermost layer of the structural element 4. Accordingly, the lines 6 are each arranged in particular within the stabilizing layer 16. In an alternative the stabilizing layer 16 is formed as a winding. As outermost layer, the cable 2 lastly comprises an outer sheathing 18, which is applied as a common outer sheathing 18 around all lines 6, the structural element 4 and the shield 14.

Figure 2:
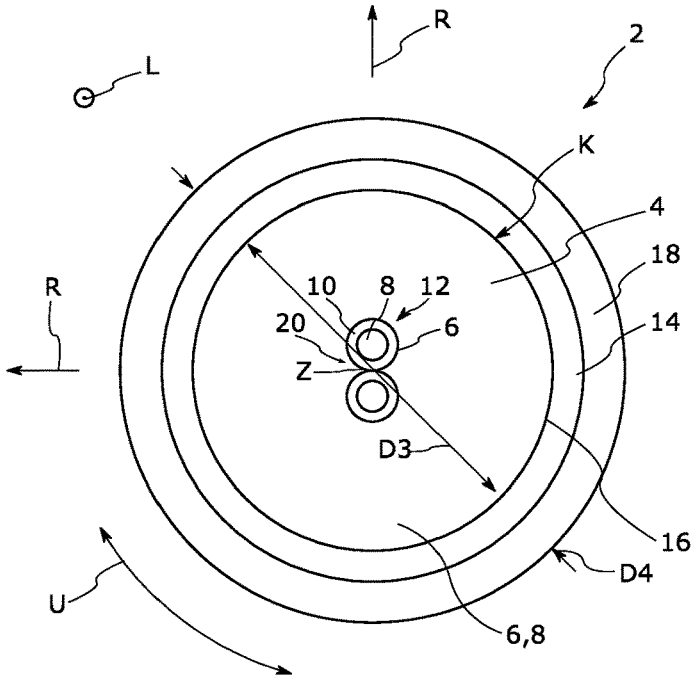
FIG. 2 schematically shows a variant of the cable.

FIG. 2 shows a variant of the cable 2, in which the structural element 4 per se is formed as a cylinder extending in the longitudinal direction L, i.e. perpendicularly to the radial direction R, in which cylinder a number of lines 6 are embedded. The two lines 6 here are each formed as a core 12, having a conductor 8 and an insulation 10 surrounding this in each case. In the exemplary embodiment shown here the lines 6 are guided close to the center Z of the cable 2 and are thus distanced maximally from the shield 14 in the radial direction R. The lines 6 additionally form a number of triangular spaces 20, which are filled by the structural element 4. As already in FIG. 1, the structural element 4 here has a circular peripheral contour K as well.

LIST OF REFERENCE SIGNS

2 cable
4 structural element
6 line
8 conductor
10 insulation
12 core
14 shield
16 stabilizing layer
18 outer sheathing
20 triangular space
D1, D2, D3, D4 diameter
L longitudinal direction R radial direction
U peripheral direction
Z center

The invention claimed is:

1. A cable, comprising:

a structural element for stiffening the cable extending in a longitudinal direction of the cable, said structural element being rigid and consisting of a glass fiber-reinforced or carbon fiber-reinforced resin or plastic, said resin or plastic connecting fibers of said resin or plastic to one another for forming said structural element;

a plurality of lines embedded in said structural element; and a common shield made of a conductive material surrounding said lines and said structural element.

2. The cable according to claim 1, wherein said lines and said structural element together form a composite without gaps.

3. The cable according to claim 1, wherein said lines are embedded in a fiber-resin matrix.

4. The cable according to claim 1, wherein each of said lines is an un-shielded line.

5. The cable according to claim 1, wherein said structural element is guided centrally.

6. The cable according to claim 1, wherein said structural element has a circular peripheral contour in cross section perpendicularly to the longitudinal direction.

7. The cable according to claim 1, wherein said structural element is formed as a cylinder, and said lines are embedded in said cylinder.

8. The cable according to claim 1, wherein said lines are each arranged in a radial direction in an outer-most portion of said structural element.

9. The cable according to claim 1, wherein said lines are distributed uniformly in a circumferential direction.

10. The cable according to claim 1, wherein at least one of said lines comprises a plurality of conductors, which are insulated from one another and which are stranded with one another.

11. The cable according to claim 1, which comprises a stabilizing layer arranged between said structural element and said shield.

12. The cable according to claim 1, which comprises an outer sheathing disposed to surround said shield.

13. The cable according to claim 1, configured for use with a camera system for examining pipelines.

14. A cable, comprising:

a structural element for stiffening the cable extending in a longitudinal direction of the cable, said structural element being rigid and consisting of a glass fiber-reinforced or carbon fiber-reinforced resin or plastic, said resin or plastic connecting fibers of said resin or plastic to one another for forming said structural element;

a plurality of lines embedded in said structural element;

a resin added to said structural element and said lines being glued to said structural element; and a common shield made of a conductive material surrounding said lines and said structural element.

15. The cable according to claim 14, wherein said stabilizing layer is formed as a winding or a braid.

16. A method of producing a cable which extends in a longitudinal direction, the method comprising:

embedding a number of lines in a structural element extending in the longitudinal direction and configured for stiffening the cable;

surrounding the structural element and the lines embedded in the structural element with a common shield made of a conductive material;

forming the structural element as a rigid structural element consisting of a glass fiber-reinforced or carbon fiber-reinforced resin or plastic, said resin or plastic connecting fibers of said resin or plastic to one another for forming said structural element.

17. The method according to claim 16, which comprises producing a cable according to claim 1.

18. The method according to claim 16, wherein the structural element is produced from a fiber material, and wherein the lines are embedded in the structural element to form a common composite from the lines and the fiber material.

19. The method according to claim 18, which comprises drawing the composite through a resin bath and then curing.

20. A method of producing a cable which extends in a longitudinal direction, the method comprising:

embedding a number of lines in a structural element extending in the longitudinal direction and configured for stiffening the cable;

surrounding the structural element and the lines embedded in the structural element with a common shield made of a conductive material;

forming the structural element as a rigid structural element consisting of a glass fiber-reinforced or carbon fiber-reinforced resin or plastic, said resin or plastic connecting fibers of said resin or plastic to one another for forming said structural element and adding a resin to the structure element and gluing the lines to the structural element.

* * * * *